US006499325B1

(12) United States Patent
Hurskainen

(10) Patent No.: US 6,499,325 B1
(45) Date of Patent: Dec. 31, 2002

(54) ELECTROMECHANICAL ACTUATOR

(75) Inventor: Oiva Hurskainen, Joensuu (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 09/507,441

(22) Filed: Feb. 18, 2000

(30) Foreign Application Priority Data

Feb. 19, 1999 (FI) ..... 990357

(51) Int. Cl.[7] ..... E05B 47/00
(52) U.S. Cl. ..... 70/276; 70/283; 292/144
(58) Field of Search ..... 70/276–283; 292/144, 292/201

(56) References Cited

U.S. PATENT DOCUMENTS

| | | | | |
|---|---|---|---|---|
| 4,784,415 A | * | 11/1988 | Malaval | 292/144 |
| 4,807,454 A | * | 2/1989 | Sengupta et al. | 70/277 |
| 5,010,750 A | * | 4/1991 | Boser et al. | 70/276 |
| 5,699,686 A | * | 12/1997 | Neumayer et al. | 70/283 |
| 5,934,119 A | * | 8/1999 | Keller | 70/276 |
| 6,035,675 A | * | 3/2000 | Zimmer et al. | 70/186 |

FOREIGN PATENT DOCUMENTS

| | | |
|---|---|---|
| DE | 40 29 208 | 3/1992 |
| EP | 0 943 763 | 9/1999 |
| FI | 100907 | 3/1998 |

* cited by examiner

*Primary Examiner*—Suzanne Dino Barrett
(74) *Attorney, Agent, or Firm*—John Smith-Hill; Smith-Hill and Bedell

(57) ABSTRACT

An electromechanical actuator comprises a body element and an elongated interaction element. One of the elements includes an electromagnet and the other ferromagnetic material or permanent magnet. The elements are arranged with respect to each other so that a rotational motion may be imparted to the interaction element by a magnetic field created by the electromagnet. The interaction element is rotatable between two rotational positions by changing the polarity of energization of the electromagnet. At one rotational position the interaction element is displaceable by an external force applied to one end in a direction along its rotation axis. The interaction element cooperates with the body element in a manner such that they together define the range of axial movement of the interaction element.

18 Claims, 3 Drawing Sheets

Fig. 7
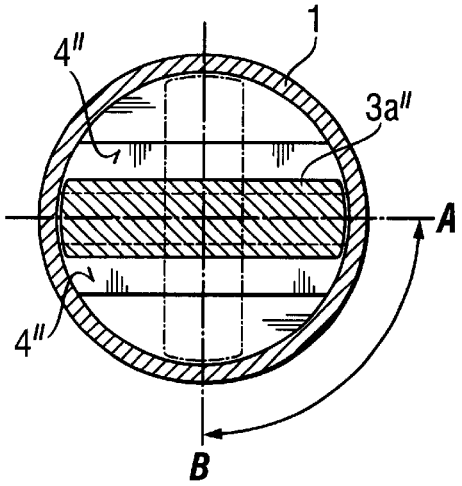
Fig. 6
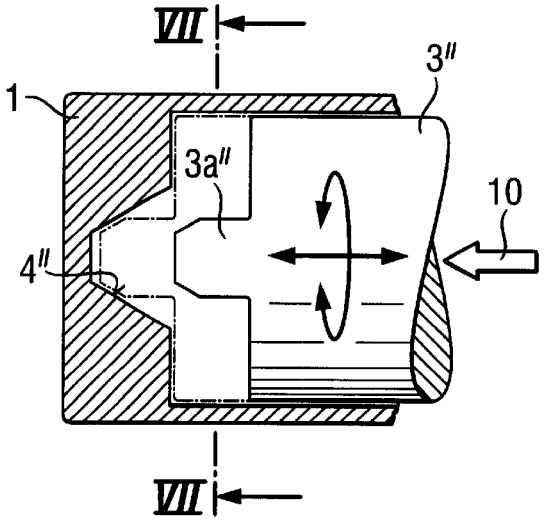
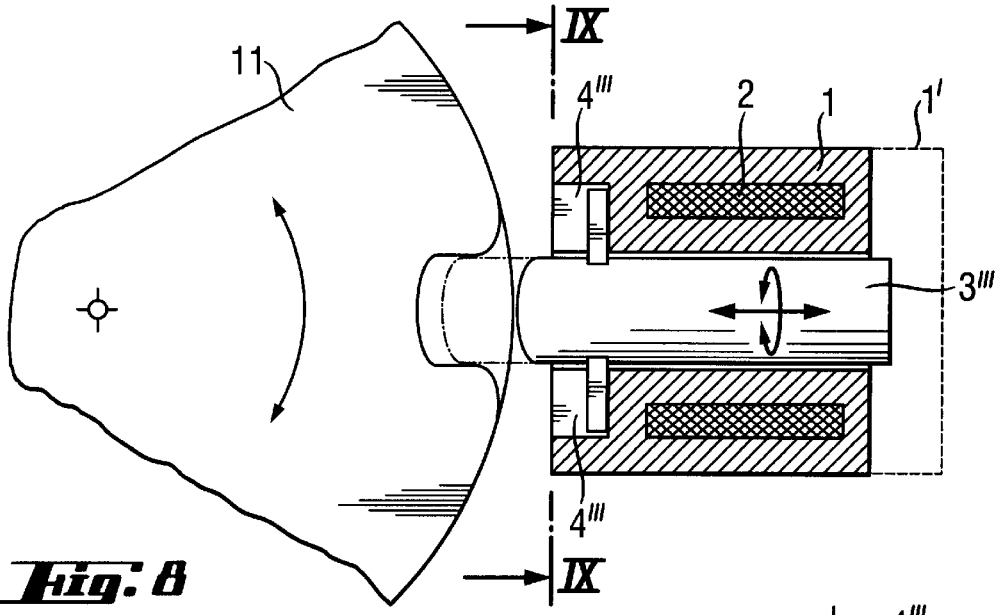
Fig. 8
Fig. 9
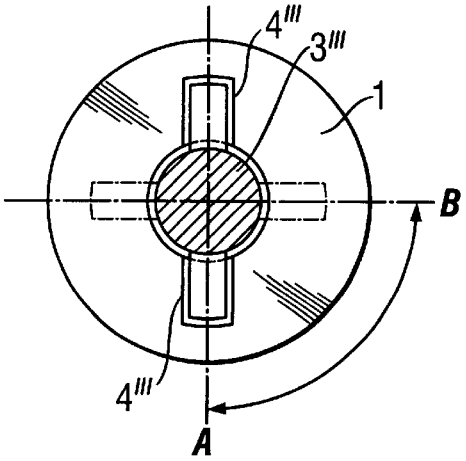

ELECTROMECHANICAL ACTUATOR

BACKGROUND OF THE INVENTION

This invention relates to an electromechanical actuator which comprises a body element and an elongated interaction element, wherein one of the elements includes an electromagnetic means and the other element includes magnetic material. The term "magnetic material" as used in this specification includes ferromagnetic material and permanent magnet material. The elements are arranged with respect to each other so that a rotational motion may be imparted to the interaction element by a magnetic field created by the electromagnetic means.

Publication FI 1000907 shows an electromechanical cylinder lock arrangement which comprises a body part of the lock and, inside thereof, a lock cylinder, which in the open position of the lock mechanism is turnable relative to the body part, and a blocking means functionally dependent on an electronic code and which in its locking position impedes turning of the lock cylinder with regard to the body part independent of the lock mechanism. The blocking means comprises an electromechanically turnable blocking member, which is adapted to a guiding groove made in the lock cylinder or in a turnable member continuously turning therewith so that in its locking position it impedes the free turning movement of the lock cylinder relative to the body part. In this solution the blocking member is turnable and thus it requires always a guiding groove to be arranged in and this in turn results in more space consuming arrangement.

An arrangement for blocking rotation of a locking apparatus is shown in DE 4029208. The solution is, however, very complicated with numerous components and therefore also for example its reliability is questionable.

In the field of locking and precision mechanics there is demand for an electromechanical actuator which is fairly mall in size, simple in construction and reliable, and by means of which it is possible to provide or allow a desired movement of a member and thus accomplish or stop an activity. The demand of electric power should also be kept reasonable, so that a simple, safe and cost-effective power source arrangement may be used.

SUMMARY OF THE INVENTION

It is an object of the invention to provide such an actuator. It is also an object of the invention to provide an actuator which is more advanced and reliable and less space consuming than those of prior art.

According to the invention the interaction element is rotatable between two rotational positions by changing polarity of the electromagnetic means so that in a first rotational position the interaction element is displaceable along its rotation axis by an external force. The interaction element receives the external force by virtue of its being disposed in the body element so that one end is accessible at least to such an extent that it is capable of receiving the external force. The interaction element is arranged to co-operate with the body element in a manner such that they together define the range of movement of the interaction element relative to the body element. According to a preferred embodiment of the invention an end of the interaction element is arranged to co-operate with guiding surfaces inside the body element in a manner such that they together define the range of movement of the interaction element in the axial direction.

In the body element there is favorably a limit stop means for restricting the range of rotation of the interaction element and hence for defining the two rotational positions. In this manner the consumption of electric power may be minimized because an electric pulse is sufficient to activate the rotational movement of the interaction element and current need be supplied for only a short period in order to rotate the interaction element from one limit position to the other and maintain it at this position. The solution is also reliable. In practice the range of rotation of the interaction element is preferably about 60°–90°.

For controlling the axial movement of the interaction element the interaction element has an inner end which is rotationally asymmetrical. Preferably, the inner end is delimited by two parallel surfaces, in the manner of a bar, and the guiding surfaces of the body element are parallel and define a chamber which is slot form for receiving the inner end of the interaction element in one rotational position of the interaction element. Then the periphery of the chamber may comprise a step-wise counter surface. Additionally the chamber contains a release spring for the interaction element. Alternatively the chamber may be defined between bevelled guiding surfaces, which are arranged to guide the axial return movement of the interaction element.

For ensuring that the interaction element remains in the rotational position to which it is rotated by the electromagnetic means in the event of possible external magnetic fields or other disturbances, such as vibration, the body element may be provided with a permanent magnet, by means of which the interaction element may be maintained at the rotational position to which it is turned by the electromagnetic means without continuously energizing the electromagnetic means.

BRIEF DESCRIPTION OF THE DRAWINGS

In the following the invention is described, by way of example, with reference to the attached drawings, in which FIG. 3 shows the actuator of FIG. 1 with the interaction element pressed in, FIG. 5 shows the actuator of FIG. 4 with the interaction element pressed in, FIG. 6 shows schematically a detail of the end of the interaction element of a third actuator in accordance with the invention, FIG. 7 is a section on the line VII—VII of FIG. 6, FIG. 8 shows schematically a fourth actuator in accordance with the invention with the interaction element pressed in, and FIG. 9 is a sectional view on the line IX—IX of FIG. 8.

DETAILED DESCRIPTION

Figure 1:
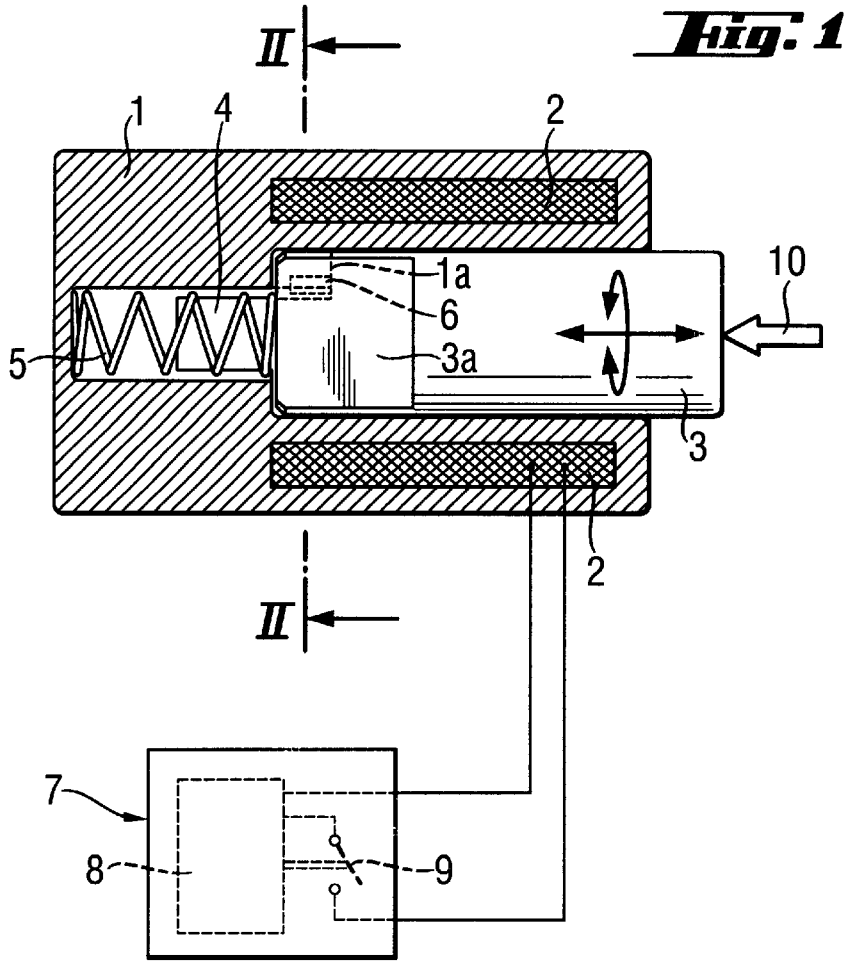
FIG. 1 shows schematically a first actuator in accordance with the invention as longitudinal projection and an interaction element of the actuator at its initial position.

In the drawings, 1 designates a body element of an actuator. The body element 1 accommodates an electromagnetic means 2. Further, the body element 1 is formed with a cylindrical bore which contains an interaction element 3. Inside the body element 1, confronting an inner end 3*a* of the interaction element 3, is a chamber 4 which cooperates with the inner end 3*a* of the interaction element as will be described below in more detailed manner.

The interaction element 3 is made of ferromagnetic material in such a manner that switching on electric current to the electromagnetic means 2 brings about a rotational motion of the interaction element in a certain direction. Reversing the polarity of energization of the electromagnetic means 2, i.e. reversing the direction of the current, brings about a rotational motion of the interaction element in the opposite direction. For controlling the operation of the electromagnetic means 2, in FIG. 1 there is shown schematically a controlling means 7, which comprises a logic circuit 8 and a switch 9 operating in response to the logic circuit and by means of which the circuit of the electromagnetic means 2 may be closed and opened. Depending on the application, the logic circuit 8 receives its input signals based on external operating conditions and changes in external operating conditions. Additionally the controlling means 7 comprises a means (not shown) for altering the direction of the current known as such in the art.

The system requires operating power, and a power source may, again depending on the application, be located in the body element 1 or in structures of the apparatus in the vicinity of the body element, or the power may be fed from an external device when needed, for example, in a lock application from a key for the lock together with an electronic code whenever the actuator is required.

Figure 2:
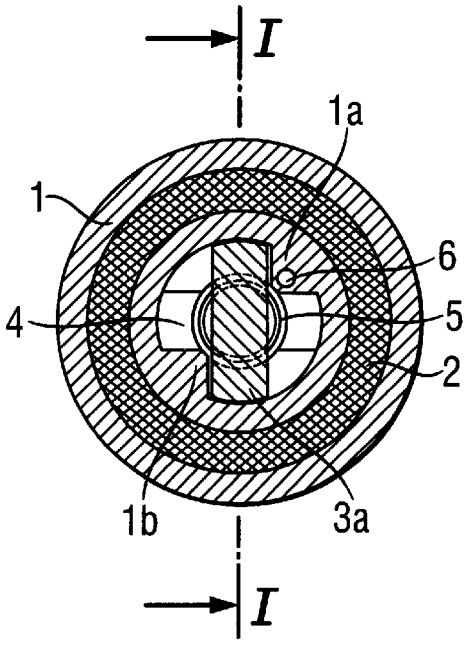
FIG. 2 shows elevation II—II of FIG. 1.

In order to control the rotational motion of the interaction element the body element 1 is provided with limit snge of rotational motion between two extreme limit positions is limited, for example to a value in the range 60°–90°. For convenience, the extreme position shown in FIGS. 1 and 2 is referred to herein as the initial position whereas the other extreme position is referred to as the final position. Additionally the body element 1 is provided with a permanent magnet 6, by means of which the interaction element may be retained at whichever rotational position it is turned to by the electromagnetic means 2. In this manner it is possible to ensure an undisturbed operation of the interaction element.

The end 3*a* of the interaction element 3 and the chamber 4 are designed so that at the initial position of the interaction element displacement of the interaction element relative to the body element by external force 10 is prevented. Conversely, at the final position the interaction element 3 can be pressed into the body element 1 by the external force 10, as shown in FIG. 3, whereupon it may be simultaneously arranged to allow or provide a desired action depending on a respective application.

Figure 3:
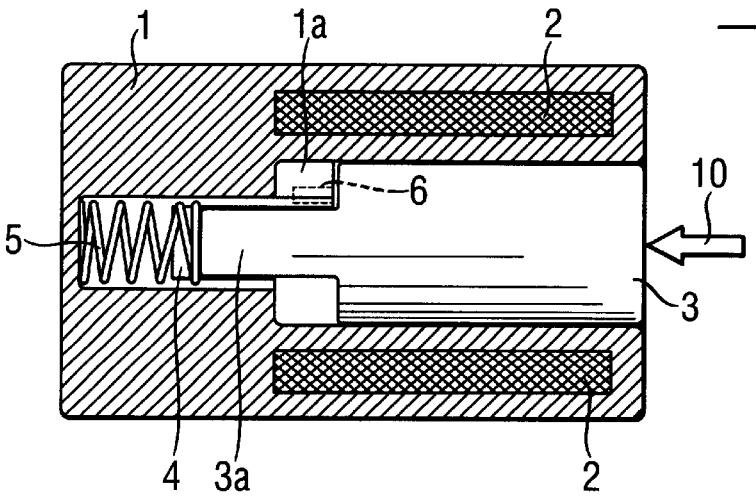

In the embodiment of FIGS. 1–3 both the end 3*a* of the interaction element 3 and the counter surfaces of the chamber 4 are step-wise tapered, so that the end 3*a* of the interaction element 3 fits into the chamber only at its final position. A spring 5 in the chamber 4 returns the interaction element 3 to its axially outmost position when the external force 10 removed. The interaction element can then be rotated back to its initial position by the electromagnetic means 2.

Figure 4:
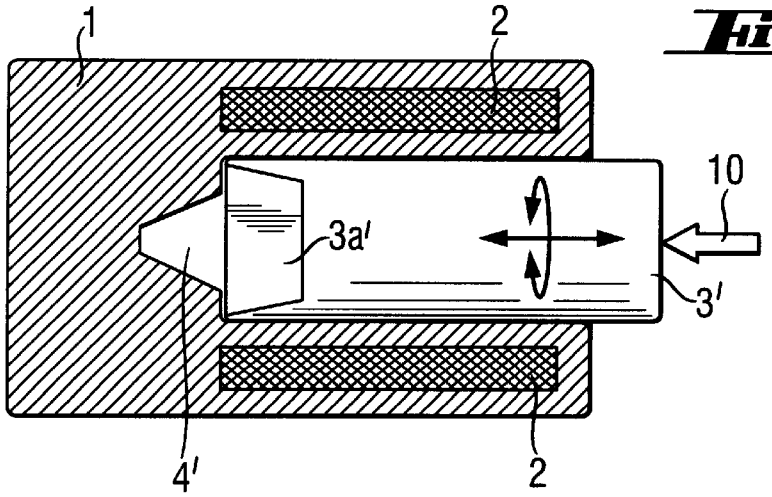
FIG. 4 shows schematically a second actuator in accordance with the invention with the interaction element at its initial position.
Figure 5:
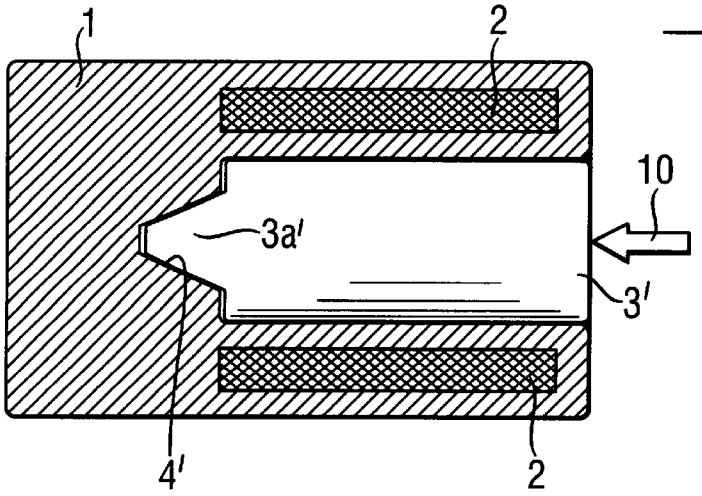

The embodiment shown in FIGS. 4 and 5 differs from the embodiments of FIGS. 1–3 in respect of the inner end of the interaction element 3 and in respect of the chamber 4'. In this embodiment the inner end 3*a*' of the interaction element 3' is tapering continuously or wedge-wise and the chamber 4' has V-shaped guiding side surfaces. On account of these, the interaction element 3' and the side surfaces of the chamber 4' cooperate in the manner of a cam follower and a cam, and axial return motion of the interaction element 3' from the state shown in FIG. 5 to the state shown in FIG. 4 may be accomplished by forced control without need for a spring by utilizing the rotational motion of the interaction element 3'.

In the embodiment of FIGS. 6 and 7 the chamber 4" has bevelled guiding surfaces in a manner explained before for accomplishing a return motion of the interaction element. In this case the end 3*a*" of the interaction element 3" is step-wise tapering, but is rounded or chamfered at its outermost end so that the bevelled surfaces of the chamber 4" may accomplish the return of the interaction element also in this case without need for a spring. FIG. 7 illustrates the interaction element 3" in the final position (position A) in solid lines and in the initial position (position B) in dashed lines.

Applying the invention does not require great consumption of power since for the purpose it is possible to use 2.5 volts power, by means of which a capacitor of 50–100 $\mu$F capacitance is charged for providing a short, for example 3 ms, relatively strong pulse of electric current. After the pulse the current may be 3–10 mA. The total duration of effect may be below 20 ms.

In the embodiments presented above the interaction element extends significantly beyond the body element 1 at the end to which the external force 10 is applied. This is not necessary for operation of the actuator, but it is enough that the end of the interaction element is accessible so that force can be applied to it. Hence the end of the interaction element may even at its outermost position remain at the level of the outer surface of the body element, and it may even be positioned for example in a cavity or recess of suitable size, from where it can be pressed into a more inward position by the external force.

In FIG. 8 there is shown an embodiment in which rotational movement of a circular or cylindrical element 11 or the like of a lock cylinder of a lock arrangement (not shown) may be allowed or restricted. The interaction element extends from the body element 1 at its initial position into co-operation with the element 11 so that it may operate as a blocking means and if so desired the rotation of the element 11 may be prevented. Since the interaction element serves simultaneously also as blocking means, this leads to a more simple and reliable arrangement. In this embodiment the chamber 4 for cooperating with the interaction element 3'" is intermediate the ends of the interaction element. So in this embodiment both ends of the interaction element 3'" are available for interacting with external force if so desired. It is also possible to provide the body element 1 at one end with a backing plate 1' or the like shown by dotted line in case that end should favorably be closed. The element 11 may represent for example a shaft for transmitting rotational movement from a key to a lock barrel (not shown) or it may also represent a locking disk of a cylinder lock for which the present invention provides a very convenient solution due to its simple construction and small size.

The interaction element or a part of it may be made of ferromagnetic material, but the interaction element or a part of it may as well comprise a permanent magnet. If the limit stop means 1*a* and 1*b* are in this case of ferromagnetic material, for example steel, the permanent magnet 6 is not required. Still another alternative solution for providing the rotational motion itself is positioning a coil inside the interaction element and a permanent magnet in the body element. The interaction element may be in a form of a circular pin arranged in a bore or the like in the body element.

This application is related to U.S. patent application Ser. No. 09/272,804 filed Mar. 19, 1999, the entire disclosure of which is hereby incorporated by reference herein.

The invention is not restricted to the embodiments shown, but several modifications are feasible within the scope of the attached claims.

What is claimed is:

1. An electromechanical actuator comprising:

a body element, and an elongated interaction element which is rotatable relative to the body element about a rotational axis between a first rotational position, in which the interaction element is displaceable relative to the body element along the rotational axis from a first longitudinal position to a second longitudinal position under the influence of an external force, and a second rotational position in which displacement of the interaction element relative to the body element from the first longitudinal position towards the second longitudinal position is positively prevented, and wherein one of said elements includes an electromagnetic means and the other of said elements includes magnetic material and said elements are arranged with respect to each other so that magnetic interaction of the magnetic material and the electromagnetic means creates a torque urging the interaction element to rotate from the first rotational position to the second rotational position when the electromagnetic means is energized in a first polarity and creates a torque urging the interaction element to rotate from the second rotational position to the first rotational position when the electromagnetic means is energized in a second polarity, opposite the first polarity.

2. An actuator according to claim 1, wherein the body element includes a limit stop means for restricting rotation of the interaction element.

3. An actuator according to claim 2, wherein the interaction element is rotatable through a range of about 60°–90°.

4. An actuator according to claim 1, wherein the interaction element has an end portion which is narrower along a first axis transverse to the rotational axis than along a second axis transverse to the rotational axis and the body element has guiding surfaces which define a chamber which is narrower than the end portion of the interaction element along the second axis and into which the end portion of the interaction element can enter when the interaction element is at the first rotational position.

5. An actuator according to claim 4, wherein the periphery of the chamber has a step-wise counter surface for restricting movement of the interaction element and the chamber contains a release spring for urging the interaction element from the second longitudinal position towards the first longitudinal position.

6. An actuator according to claim 4, wherein the chamber is bounded by bevelled guiding surfaces, which guide the axial return movement of the interaction element.

7. An actuator according to claim 1, wherein the body element includes a permanent magnet for retaining the interaction element at the rotational position to which the interaction element is turned by the electromagnetic means.

8. An actuator according to claim 1, wherein an end of the interaction element cooperates with guiding surfaces of the body element in a manner such that they together define a range of movement of the interaction element in axial direction.

9. An actuator according to claim 1, wherein the interaction element is arranged relative to the body element so that an end of the interaction element is accessible for receiving the external force and is arranged to extend into cooperation with a member of a locking device where by rotational movement of the member may be selectively allowed or restricted.

10. An electromechanical actuator comprising:

a body element Including an electromagnetic means, and an elongated interaction element which includes magnetic material and is rotatable relative to the body element about a rotational axis between a first rotational position, in which the interaction element is displaceable relative to the body element along the rotational axis from a first longitudinal position to a second longitudinal position under the influence of an external force, and a second rotational position in which the body element positively prevents displacement of the interaction element relative to the body element from the first longitudinal position towards the second longitudinal position, and wherein said elements are arranged with respect to each other so that magnetic interaction of the magnetic material and the electromagnetic means creates a torque urging the interaction element to rotate from the first rotational position to the second rotational position when the electromagnetic means is energized in a first polarity and creates a torque urging the interaction element to rotate from the second rotational position to the first rotational position when the electromagnetic means is energized in a second polarity, opposite the first polarity.

11. An actuator according to claim 10, wherein the body element includes a limit stop means for restricting rotation of the interaction element.

12. An actuator according to claim 11, wherein the interaction element is rotatable through a range of about 60°–90°.

13. An actuator according to claim 10, wherein the interaction element has an end portion which is narrower along a first axis transverse to the rotational axis than along a second axis transverse to the rotational axis and the body element has guiding surfaces which define a chamber which is narrower than the end portion of the interaction element along the second axis and into which the end portion of the interaction element can enter when the interaction element is at the first rotational position.

14. An actuator according to claim 13, wherein the periphery of the chamber has a step-wise counter surface for restricting movement of the interaction element and the chamber contains a release spring for urging the interaction element from the second longitudinal position towards the first longitudinal position.

15. An actuator according to claim 13, wherein the chamber is bounded by bevelled guiding surfaces, which guide the axial return movement of the interaction element.

16. An actuator according to claim 10, wherein the body element includes a permanent magnet for retaining the interaction element at the rotational position to which the interaction element is turned by the electromagnetic means.

17. An actuator according to claim 10, wherein an end of the interaction element cooperates with guiding surfaces of the body element in a manner such that they together define a range of movement of the interaction element in axial direction.

18. An actuator according to claim 10, wherein the interaction element is arranged relative to the body element so that the end of the interaction element is accessible for receiving the external force and is arranged to extend into cooperation with a member of a locking device whereby rotational movement of the member may be selectively allowed or restricted.

* * * * *